US009638126B2

(12) United States Patent
Vosburg

(10) Patent No.: US 9,638,126 B2
(45) **Date of Patent: *May 2, 2017**

(54) ELECTRONICALLY CONTROLLED LEAN OUT DEVICE FOR MECHANICAL FUEL INJECTED ENGINES

(71) Applicant: Delbert Vosburg, Avoca, PA (US)

(72) Inventor: Delbert Vosburg, Avoca, PA (US)

( * ) Notice: Subject to any disclaimer, the term of this patent is extended or adjusted under 35 U.S.C. 154(b) by 383 days.

This patent is subject to a terminal disclaimer.

(21) Appl. No.: 14/251,468

(22) Filed: Apr. 11, 2014

(65) Prior Publication Data

US 2014/0309908 A1 Oct. 16, 2014

Related U.S. Application Data

(60) Provisional application No. 61/811,478, filed on Apr. 12, 2013.

(51) Int. Cl.
*F02D 41/00* (2006.01)
*F02D 41/14* (2006.01)

(52) U.S. Cl.
CPC ..... *F02D 41/1475* (2013.01); *F02D 41/1456* (2013.01); *F02D 2400/11* (2013.01)

(58) Field of Classification Search
CPC .... F02M 59/20; F02M 39/205; F02M 59/102; F02M 59/34; F02M 59/361; F02M 59/362; F02M 59/363; F02M 59/366; F02D 41/1475; F02D 2400/11
USPC ..... 123/672–700, 457–462
See application file for complete search history.

(56) References Cited

U.S. PATENT DOCUMENTS 3,460,520 A * 8/1969 Robert ..... F02M 51/02 123/450
3,643,635 A * 2/1972 Milam ..... F02D 41/1446 123/357
3,815,561 A * 6/1974 Seitz ..... F02D 41/1479 123/696
3,911,884 A * 10/1975 Moriya ..... F02M 69/18 123/458
3,942,496 A * 3/1976 Eisele ..... F02D 35/0092 123/454
4,003,350 A * 1/1977 Eisele ..... F02D 41/1487 123/454
4,015,571 A * 4/1977 Stumpp ..... F02D 1/02 123/452

(Continued)

*Primary Examiner* — Thomas Moulis
(74) *Attorney, Agent, or Firm* — White-Welker & Welker, LLC; Matthew T. Welker, Esq.

(57) ABSTRACT

A device for the electronically controlled lean out of mechanical fuel injected engines comprising a wide band air fuel ratio sensor and a printed circuit board (PCB) connected to the wide band air fuel ratio gauge/controller. The printed circuit board (PCB) is connected to the wide band air fuel ratio sensor's power, ground, and signal wires. The computer controlled stepper motor is connected to the printed circuit board (PCB). A variable valve spool is retained in a fuel block and connected to the computer controlled stepper motor. Rotating the variable valve spool continuously adjusts and controls the air fuel ratio of the engine in real time by regulating the amount of fuel returned the fuel tank and the amount of fuel delivered to the barrel valve in a mechanically fuel injected engine. A jet can be used in combination with the fuel bock to further fine tune the fuel flow.

10 Claims, 6 Drawing Sheets

(56) References Cited

U.S. PATENT DOCUMENTS 4,027,637 A * 6/1977 Aono ..... F02D 41/1479 123/443
4,062,337 A * 12/1977 Rivere ..... F02D 35/003 123/384
4,075,995 A * 2/1978 Kramer ..... F02M 69/386 123/452
4,133,320 A * 1/1979 Bianchi ..... F02D 41/3005 123/436
4,140,085 A * 2/1979 Rabus ..... F02D 41/1496 123/693
4,144,855 A * 3/1979 Masui ..... F02M 7/24 123/588
4,164,914 A * 8/1979 Hattori ..... F02D 35/003 123/587
4,174,690 A * 11/1979 Sumiyoshi ..... F02D 41/0027 123/698
4,192,268 A * 3/1980 Hattori ..... F02M 23/04 123/700
4,205,636 A * 6/1980 Kimata ..... F02D 41/32 123/455
4,213,430 A * 7/1980 Minami ..... F02D 21/08 123/310
4,215,656 A * 8/1980 Manaka ..... F02D 41/1479 123/688
4,285,319 A * 8/1981 Hattori ..... F02D 41/1481 123/682
4,314,535 A * 2/1982 Takeuchi ..... F02D 35/0061 123/438
4,348,998 A * 9/1982 Stumpp ..... F02D 1/12 123/447
4,353,385 A * 10/1982 Maisch ..... F02M 69/26 123/459
4,446,837 A * 5/1984 Elpern ..... F02D 41/345 123/460
4,469,070 A * 9/1984 Rassey ..... F02M 69/043 123/459
4,508,091 A * 4/1985 Wakeman ..... F02M 51/0617 123/458
4,509,483 A * 4/1985 Johnson ..... F02M 51/02 123/438
4,517,134 A * 5/1985 Nakamura ..... F02M 7/133 123/439
4,530,329 A * 7/1985 Maisch ..... F02M 55/00 123/446
4,549,515 A * 10/1985 Maisch ..... F02M 69/26 123/452
4,643,155 A * 2/1987 O'Neill ..... F02D 41/14 123/496
4,683,854 A * 8/1987 Goulet ..... F02D 41/30 123/198 D
4,745,903 A * 5/1988 Gmelin ..... F02M 69/26 123/452
4,838,232 A * 6/1989 Wich ..... F02M 45/04 123/300
5,213,084 A * 5/1993 Linder ..... F02M 59/366 123/456
5,341,785 A * 8/1994 Meaney ..... F02M 69/50 123/452
5,740,775 A * 4/1998 Suzuki ..... F02D 41/005 123/299
5,845,622 A * 12/1998 van den Wildenberg ..... F02M 69/18 123/458
6,694,954 B2 * 2/2004 Fraenkle ..... F02M 47/027 123/446
2003/0209232 A1 * 11/2003 Hou ..... F02D 41/3836 123/459

* cited by examiner

ELECTRONICALLY CONTROLLED LEAN OUT DEVICE FOR MECHANICAL FUEL INJECTED ENGINES

CROSS REFERENCE TO RELATED APPLICATIONS

This application claims priority from U.S. patent application Ser. No. 61/811,478, entitled "ELECTRONICALLY CONTROLLED LEAN OUT DEVICE FOR MECHANICAL FUEL INJECTED ENGINES", filed on 12 Apr. 2013. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to mechanical fuel injected engines. More specifically, the present invention relates to electronically controlled air to fuel ratios for mechanical fuel injected engines.

BACKGROUND OF THE INVENTION

In auto sports, especially drag racing, operating an engine at its optimum range produces more horsepower, resulting in a quicker and faster racecar. One factor in optimizing an engine's output is adjusting the air fuel ratio to maintain an optimum valve over the entire time of use.

Mechanical fuel injection is commonly used in many racing applications, including draft racing. In a typical mechanically fuel injected engine, fuel is drawn from a tank or cell by an engine-driven injector pump, which delivers the main fuel feed to a barrel valve through a high-flow inline filter and shutoff valve. In a high performance application a high speed bypass valve is used. During a drag racing pass or run, mechanical fuel injection is hampered by having a lean starting line condition that turns to an overly rich condition by the end of the pass or run. A high-speed bypass provides a means for returning fuel the tank or cell increasing the air fuel ratio to avoid an overly rich condition at the finish line and leaning the motor out.

There are so called electronic lean outs known in the prior art, but they only open and close at predetermined times. These electronic lean outs do not use a signal from a sensor of the car to measure and react to actual conditions; instead they use timers to make adjustments on anticipated conditions. Therefore what is needed is a device that corrects instantly in real-time and will keep the air fuel ratio static in any mechanically fuel injected motor running on alcohol or gasoline during the course of a run.

A high-speed bypass (also known as a "high-speed lean-out") is another check valve in a mechanical injection system. It opens and bleeds off fuel to a return circuit at the top end of the RPM range, thereby reducing fuel entering the engine and leaning out the air/fuel ratio (AFR). The shortcoming of a high-speed bypasses known in the prior art are that it is strictly mechanical and only provides for adjustment based on timers or a fixed setting which is insufficient to extract maximum power and efficiency from a mechanically fuel injected engine.

The most common type of high-speed bypass is a spring loaded "poppet" style that opens when a certain system pressure is achieved. Usually, the spring and shims inside can be changed so that the bypass opens at the desired pressure. Other types of bypasses can be actuated electronically or pneumatically and can be triggered directly by the driver, timers, RPM, etc. While many high performance or racing fuel systems employ a single, simple high-speed bypass, multiple simple high-speed bypasses can be used to achieve just the right fuel curve. Professional racers may use a plurality of lean-out and enrichment "events" during a pass.

The most practical reason to use a high-speed bypass is because at the top end of the RPM range, induction efficiency drops off sharply as the ability of the intake tract to pass air starts to diminish. At the top end of the RPM range the cylinders are not getting as full of air as they were in the lower RPM range. Because the mechanical injection system, with its positive displacement fuel pump, continues shooting fuel into the motor in proportion to RPM, it has no way to know that the air/fuel ration is getting richer as induction efficiency falls off and load on the engine decreases as the car accelerates through its transmission gears. A properly setup high-speed bypass will open up and pull some of that excess fuel away to correct for this condition.

The job of the high-speed bypass is to avoid an overly rich condition and keep the motor pulling hard all the way to the end of the pass. To date, all high-speed bypass valves known in the art are strictly mechanical and only provide for adjustment based on timers or a fixed setting. Therefore, what is needed is an electro-mechanical valve that can communicate with an air/fuel sensor and, using a circuit board acting as a computer, make real-time adjustments to the fuel flow to maintain a desired air/fuel ration for an entire pass.

Another reason to run the high-speed bypass is to change the air/fuel ratio altogether. A properly setup high-speed bypass can be setup to not only compensate for a drop in induction efficiency but also to shift the AFR to one that will produce the best MPH at the finish line.

Many sportsman or hobby racers will not run a high-speed bypass because it can be dangerous to engine parts if used improperly. Therefore what is needed is a device that can adjust fuel flow that monitors and uses an engine's air fuel ratio output to adjust the air fuel ratio being put into the engine to provide maximum results without the possibility for causing engine damage that is simple and easy to install.

SUMMARY OF THE INVENTION

A device for the electronically controlled lean out of mechanical fuel injected engines comprising a wide band air fuel ratio sensor and a printed circuit board (PCB) connected to the wide band air fuel ratio gauge/controller. The printed circuit board (PCB) is connected to the wide band air fuel ratio sensor's power, ground, and signal wires. The computer controlled stepper motor is connected to the printed circuit board (PCB). A variable valve spool is retained in a fuel block and connected to the computer controlled stepper motor. Rotating the variable valve spool continuously adjusts and controls the air fuel ratio of the engine in real time by regulating the amount of fuel returned the fuel tank and the amount of fuel delivered to the barrel valve in a mechanically fuel injected engine.

Fuel directed to the present invention may go through a 1 lb check valve and enters at port A and exits at port B. The amount of fuel passed through the device of the present invention is restricted by the variable valve spool controlled by the stepper motor and PCB as directed by the signals from the wideband O2 sensor located in the exhaust and displayed on a gauge in the car's interior. The device of the present invention limits the amount of fuel returned to the tank before the barrel valve to keep the engine running at a desired AFR. The regulated and adjusted fuel is then returned to the fuel tank. By constantly adjusting the amount of fuel being returned to the tank before the barrel valve, in real-time, the engine can be tuned to perform at a desired AFR for the entire run from start to finish, rather than having lean and over-rich conditions during various parts or times during the course of a run, resulting in better performance. A jet can be used in combination with the fuel bock to further fine tune the fuel flow.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Figure 1:
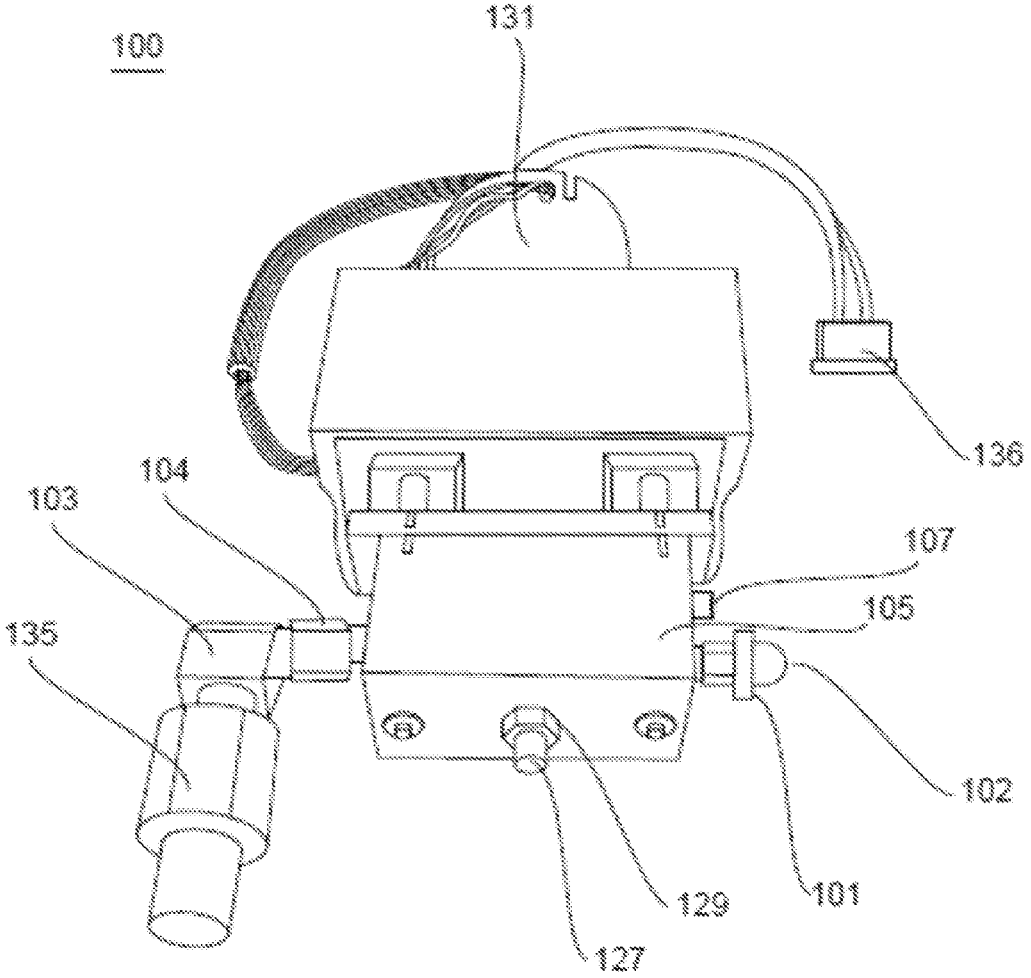
FIG. 1 illustrated the device of the present invention for electronically controlling lean out for a mechanically fuel injected motor.
Figure 3:
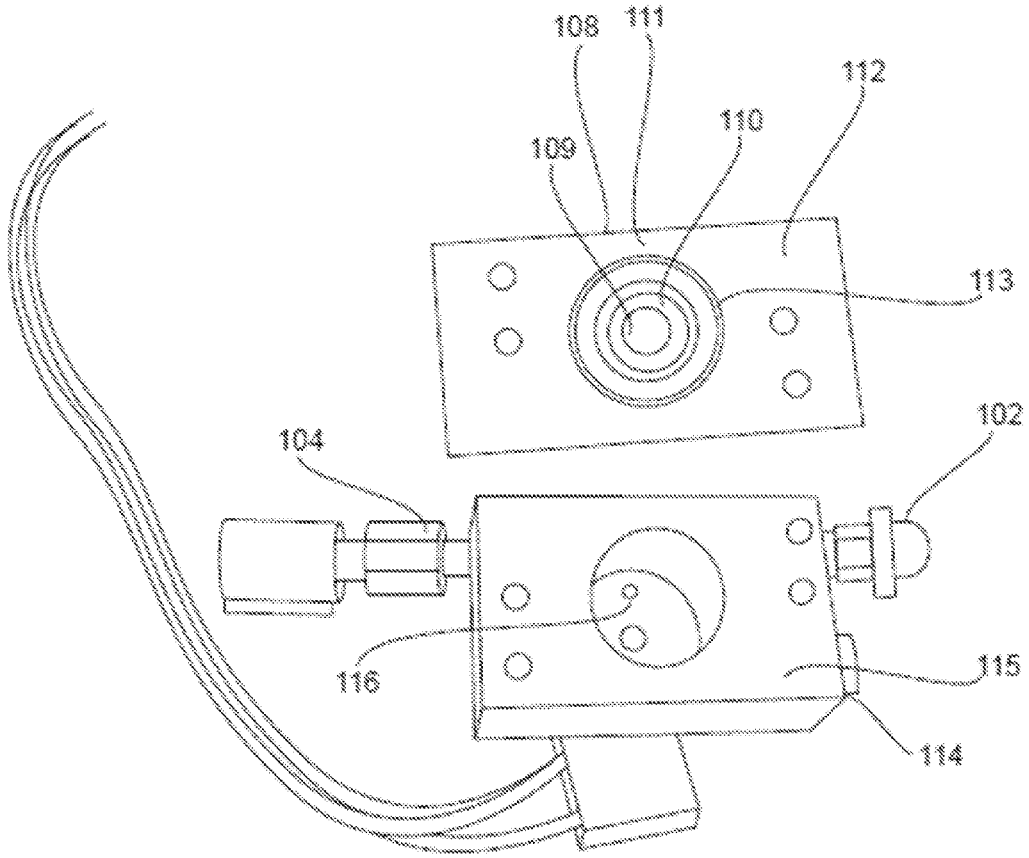
FIG. 3 illustrates a disassembled view of the fuel block of the present invention.
Figure 7:
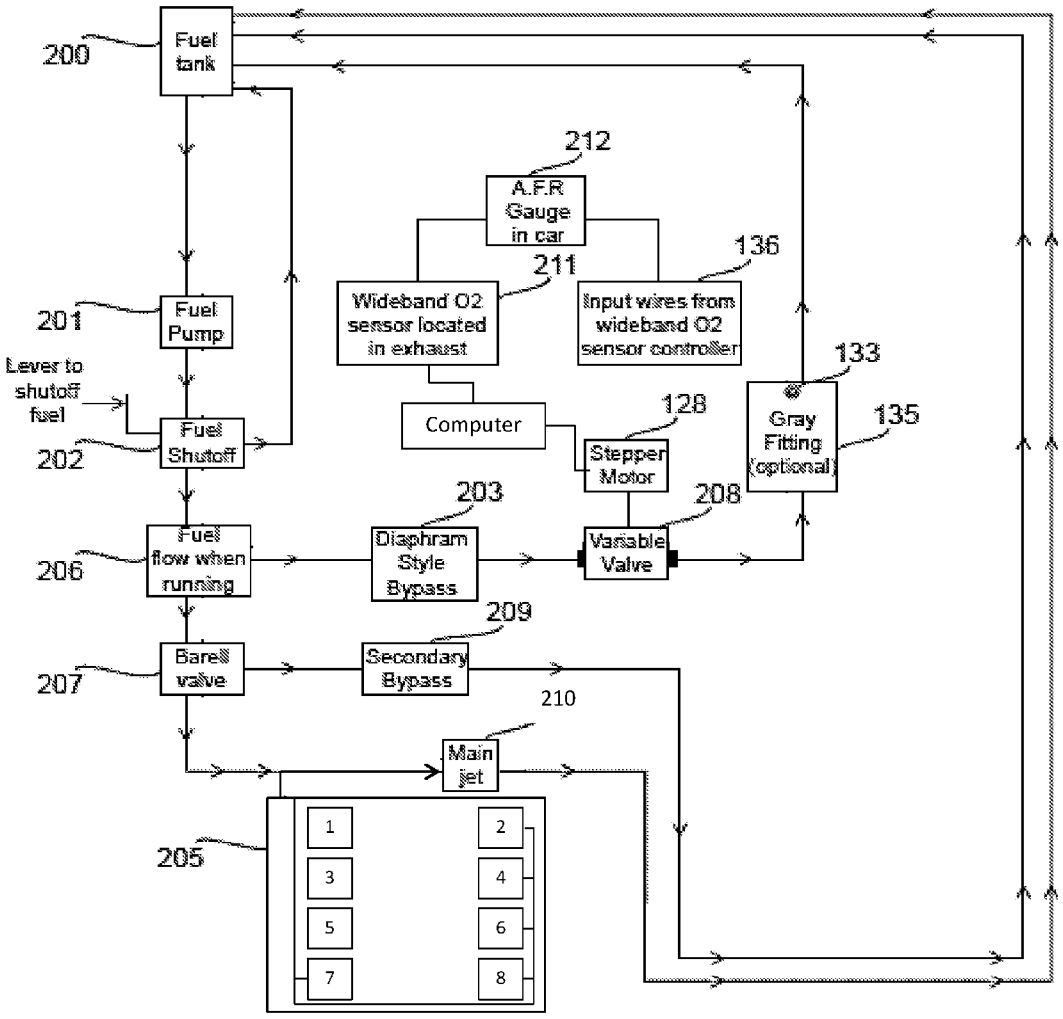
FIG. 7 illustrates one embodiment of a fuel system using the device of the present invention.

Now referring to the Figures, a device 100 providing an electronically controlled lean out for a mechanically fuel injected motor is illustrated. As shown in FIGS. 1 and 3, fuel flows from the fitting 101 located in port A 102 to the fittings 103 in port B 104, through the device body 105 which houses a cylindrical shaped variable valve spool 106 for adjusting and regulating fuel flow. Optionally, a fuel pressure gauge can be plumed into the device 100 as shown by brass plug 107 located adjacent to the fitting 101 of port A 102. A main jet 134 located between the device 208 and the injector 205 is used for coarse tuning as shown in FIG. 7.

Referring to FIG. 3, the fuel block body 105 of the device 100 is opened to better illustrate the internal parts and function. A first fuel block body side 108 is comprised of a shaft hole 109 with a lip seal 110, and a machined o-ringed grove 111 on the interior surface 112 for retaining an O-ring 113 to seal the two body sections/sides 108 and 114 when bolted together. A second fuel block body side 114 is comprised of and interior surface 115 comprising an inlet fuel port A 102 and outlet fuel port B 104, connected by a cylindrical opening 116 where a cylindrical shaped variable valve spool 106 is retained that allows for the regulation of fuel flow through the device as shown in FIG. 4.

Figure 4:
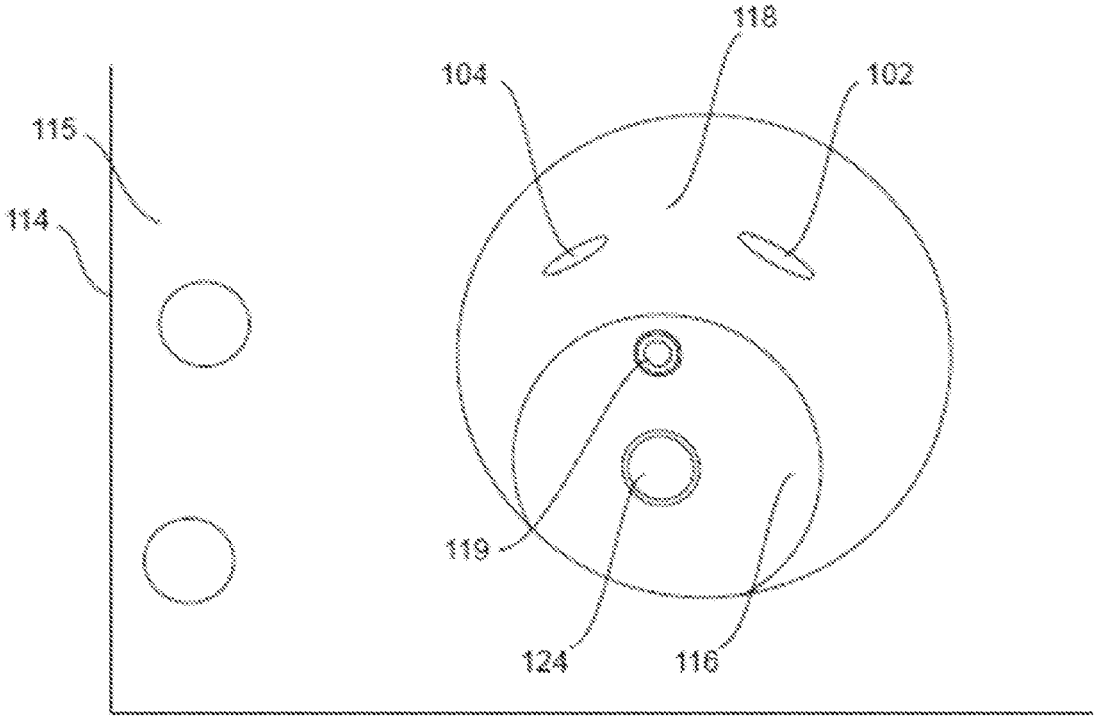
FIG. 4 illustrates the jet at the end of the fuel circuit bypass for tuning the device of the present invention.
Figure 6:
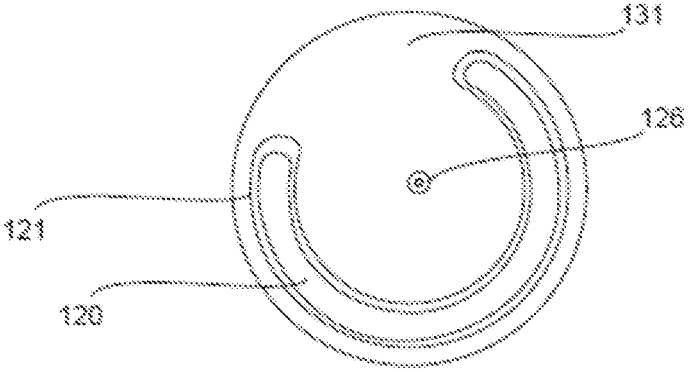
FIG. 6 illustrates the backside of the variable valve spool containing a machined surface for limiting the motion of the variable valve spool within the body with respect to a stop protrusion.

Now referring to FIG. 4, the interior surface 115 of the second body side 114 is comprised of inlet fuel port A 102 and outlet fuel port B 104 which passes fuel through the cylindrical opening 116 where the cylindrical shaped variable valve spool 106 is retained. The fuel flows from the port A 102 fuel intersection through the cylindrical opening and through the variable valve spool's valley or "v" channel 117 in the variable valve spool 106 into port B 104. A dead area 118 is provided to shut fuel off in the event of a lean condition. A cylindrical protrusion 119 limits the travel of the cylindrical shaped variable valve spool 106 when retained inside the orifice 120. The protrusion 119 matches and corresponds to a half-moon shape 121 in the bottom of the spool 106 as shown in FIG. 6 where the protrusion 119 allows the variable valve spool 106 to rotated around the shaft axis 122 from end to end of the machined half-moon shape 121 and stops the spool's motion when the protrusion 119 and end point of the machined half-moon shape 113 and protrusion 119 make contact, thus preventing engine damage by preventing the spool 106 from creating a fuel flow condition so far out of the ideal range that would lead to engine damage. The flat circular low friction area 124 is provided to reduce friction only. The center of the bottom of the spool 126 rides along and against this low friction area 124 to provide smooth movement of the spool 106.

The low friction area 124 is an Allen set screw 127 with a TEFLON coated low friction end surface 124. The set screw 127 is screwed into the second body side 114 and the pressure exerted on the spool bottom 126 is adjustable. When the desired pressure is set to retain the spool 106 in its location with little frictional draft as it is rotated by the stepper motor 128, the lock nut 129 is tighten to retain the set screw 127 and coated low friction end surface 124 securely in place at the desired setting.

Figure 5:
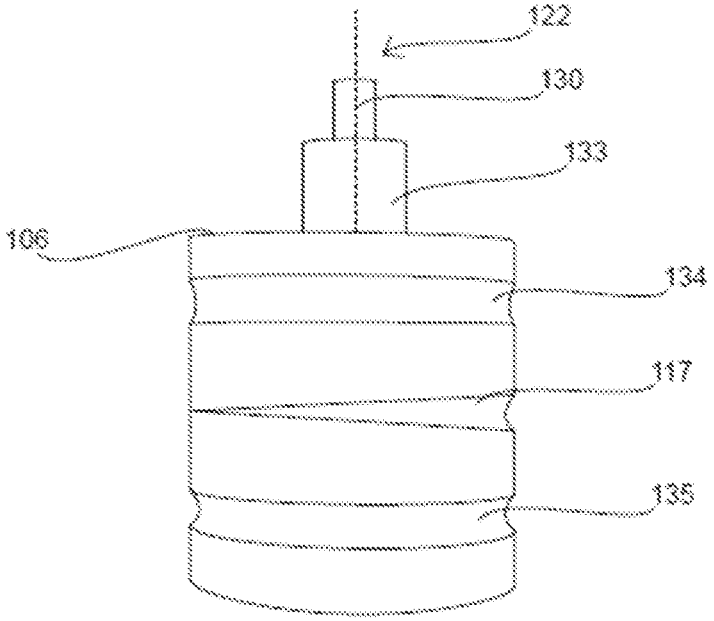
FIG. 5 illustrates the variable valve spool attached to the shaft of the stepper motor as retained within the variable valve spool orifice of the present invention.

Now referring to FIG. 5, the variable valve spool 106 is shown in greater detail. The variable valve spool 106 is comprised of a seal surface area 133, two friction reduction grooves 134 and 135, and a fuel channel 117. When the variable valve spool 106 is placed within the body 105, the lip seal 110 provides a leak free, low friction connection between the stepper motor shaft 130 and the variable valve spool 106. The opposing end of the variable valve spool 131 from the shaft 130 rides against the coated low friction end surface 124 of the interior 115 of the second body side 114 for further friction reduction. The valley or "v" shaped fuel channel 117 is aligned with the fuel channel of port A 102 and port B 104 area of the interior 115 of the second body side 114. Fuel flows through this area only. The flow is variable due to the changing depth of the valley or "v" groove 117. As the spool 106 is rotated, an increase or decrease in fuel occurs as more or less of the valley or "v" grove 117 is used to channel fuel from port A 102 to port B 104, resulting in a change in fuel delivery to the engine and an adjustment of the air fuel ratio.

Still referring to FIG. 6, there are two additionally machined channels 134 and 135 adjacent to the valley or "v" shaped fuel channel 117. These channels 134 and 135 are provided to reduce the contact area between the spool 106 and the interior surfaces 112 and 115 of the two piece body 105. The machined groove channels 134 and 135 reduce the surface contact area between the spool 106 and the interior body surfaces 112 and 115. Some fuel may enter these channels 134 and 135 and provide additional lubrication, but any fuel that enters is unable to escape or leak into the fuel channel and cannot cause an unwanted change in the amount of fuel being delivered.

Figure 2:
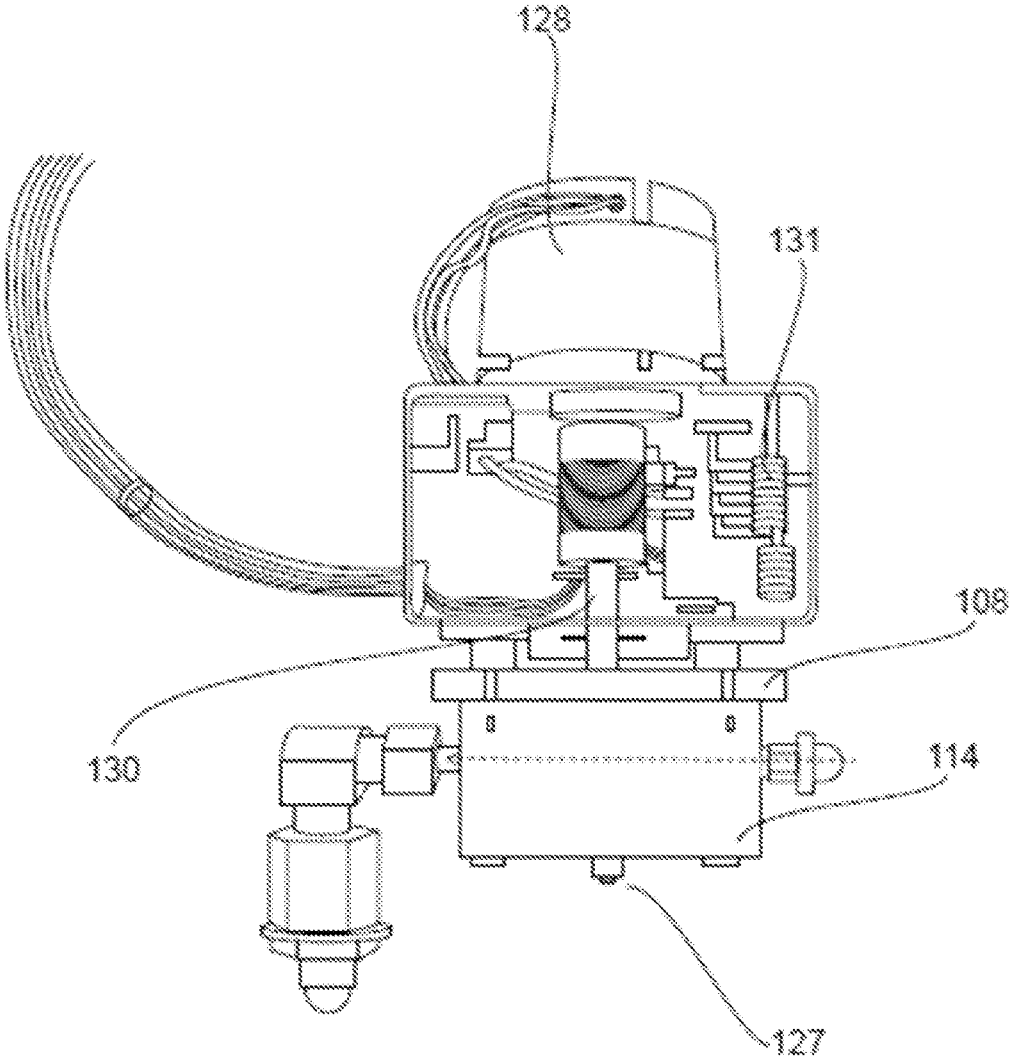
FIG. 2 illustrates the stepper motor, printed circuit board (PCB), and wiring connections used by the present invention.

The device 100 of the present invention reacts to input from a wide band air fuel ratio gauge/controller 132. The device of the present invention is comprised of a computer controlled stepper motor 128 connected to a valve 100, which corrects the air fuel ratio on mechanical fuel injected engines as shown in FIGS. 1-2. The device 100 of the present invention corrects instantly in real time and will keep the air fuel ratio static in any mechanically fuel injected motor running on alcohol or gasoline. In a drag race embodiment, the device of the present invention corrected and kept the engine at a 12.7 AFR throughout the entire run for an engine running on gasoline.

The stepper motor system on many modern cars controls exhaust gas recirculation on electronically fuel injected systems. The present invention uses a commercially available wide band air fuel ratio O2 sensor controller located in the exhaust, while the gauge may be located in the car's interior, to mechanically control fuel flow.

The present invention is designed for use on mechanical fuel injection engines and to continuously adjust and control the air fuel ratio of the engine. The input received from the wide band air fuel ratio O2 sensor by a printed circuit board (PCB) 131 is a varying zero to five volt signal, which rises when the engine goes leaner and drops when it goes richer. The stepper motor 128 reacts through the printed circuit board (PCB) 131 which in turn moves a variable valve spool 106 shown in FIG. 5, which in turn riches and leans the engine by correspondingly adjusting the fuel flow by rotating the variable valve spool 106 to change the amount of fuel being delivered to the engine. The variable valve spool 106 and stepper motor 128 will stay in position if the device loses power and warning systems can be put in place to additionally protect overly lean conditions from occurring.

Fine tuning comes from a jet 133 at the end of the fuel circuit bypass as show in FIGS. 1 and 7 and referred to as the "jet can" 135. The fuel path is parallel with the fitting 101 located at port A 102 and the right angle turn located at port B 104 to the fine tune jet of the jet can 135. The fuel follows 90 degrees to this jet can. The fuel travels straight through the variable valve spool 106 and turns 90 degrees at the end as it exits port B 104 to the jet can 135 where it is fine tuned. There are two jets 133 and 134 in the system, but the main jet 134 is located in a different spot as shown in the fuel system illustration of FIG. 7.

This fine tuning jet 133, which can be changed mechanically and replaced with a jet of varying size, restricts the overall fuel volume that flows through the variable valve spool to provide optional fine tuning The device as constructed contains a replaceable fine tuning jet 133 of appropriate size for most fuel systems that will avoid the potential for the system to run in an overly rich or overly lean condition and lead to engine damage.

The wide band air fuel ratio O2 sensor control air fuel gauge is made by AEM part #30-4100 and is not pictured. The wide band air fuel ratio O2 sensor is located in the exhaust while the gauge is located in the car's interior. The three wires 136 coming from the wide band air fuel ratio O2 sensor and into the PCB are power, ground and signal as shown in FIG. 1.

The stepper motor 128 and control PCB 131 are manufactured by HAAS M.FG, part #Epv250 as shown in FIG. 2. Typical HAAS valves open with a higher voltage signal and close with a lower voltage signal, which is the opposite of the present invention and the flow characteristics are also not the same. The valve of the present invention closes on a higher voltage signal which richens the motor and opens on a lower voltage signal which leans the motor. Substantial research and development was conducted by the inventor to overcome functional problems as they relate to the stepper motors 131 and the speed and accuracy of adjustment of the spool 106.

Now referring to FIG. 7, one embodiment of a complete fuel system using the device of the present invention is shown. Fuel is stored in a fuel tank or cell 200. The fuel is pulled from the fuel tank by a fuel pump 201. A shut off lever 202 is provided after the fuel pump to allow the fuel to be shutoff and returned to the fuel tank when the fuel pump is running but no fuel to the engine is desired. When the shut off lever 202 is opened and the engine is running, fuel is allowed to flow to a barrel valve 207 and the device of the present invention from a "T" fitting or junction 206.

At the "T" fitting or junction 206 fuel flows to either a barrel valve 207 and toward the engine, or is directed to the device of the present invention 208. Fuel directed to the barrel valve 207 is sent to the engine at wide open throttle (WOT) and is delivered to the motor through one or more injectors 205. A main jet 210 provides coarse adjustment for the excess fuel returned to the fuel tank 200 and not used by the injectors 205 and contains a 1 lb. check valve 203 as provided for idle purposes to ensure the engine will run and idle during under partial throttle conditions. At idle, the barrel valve 207 sends fuel to the motor and through a secondary bypass valve containing a 15 lb. check valve 209 to return unused fuel to the tank 200.

Fuel directed to the present invention 208 may go through a 1 lb check valve 203 and enters at port A 102 and exits at port B 104. The amount of fuel passed through the device of the present invention 208 is restricted by the variable valve spool 106 controlled by the stepper motor 128 and PCB 131 as directed by the signals from the wideband O2 sensor 211 located in the exhaust and potentially displayed on a gauge in the car's interior 212. The device of the present invention 208 limits the amount of fuel returned to the tank 200 before the barrel valve 207 to keep the engine running at a desired AFR. The regulated and adjusted fuel is then returned to the fuel tank 200. By constantly adjusting the amount of fuel being returned to the tank 200 before the barrel valve 207, in real-time, the engine can be tuned to perform at a desired AFR for the entire run from start to finish, rather than having lean and over-rich conditions during various parts or times during the course of a run, resulting in better performance.

Because every fuel injection system has its own characteristics, alternative routing of lines, placement of check valves and pressures used are open to the tuner it should be appreciated that the order of the components can be changed with the same desired results.

Diaphragm pressure regulators can also be used in different locations to control pressure in various parts of the system.

The present invention can be integrated in different areas of the fuel system. The device of the present invention can be before or after the barrel valve and can be utilized in the secondary circuit as well. The figures illustrate on embodiment of the present invention in one selected fuel system layout for a racing fuel system. The location of the device of the present invention and the fuel system layout can be different for various different desired configurations, which will be appreciated by those of ordinary skill in the art.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A device for the electronically controlled lean out of mechanical fuel injected engines comprising in combination:

a fuel tank or cell;

a fuel pump;

a shut off lever;

provided after the fuel pump to allow the fuel to be shutoff and returned to the fuel tank when the fuel pump is running but no fuel to the engine is desired;

when the shut off lever is opened and the engine is running, fuel is allowed to flow;

a barrel valve connected to the shut-off lever;

a variable valve spool contained within a fuel block for regulating fuel flow connected to the shut-off lever;

the barrel valve and variable valve spool connected from a "T" fitting or junction;

the "T" fitting or junction directs fuel flow to either the barrel valve and toward the engine, or toward the variable valve spool contained within a fuel block for regulating fuel flow;

fuel directed to the barrel valve is sent to the engine at wide open throttle and is delivered to the engine through one or more injectors;

a main jet provides coarse adjustment for the excess fuel returned to the fuel tank and not used by the injectors;

fuel directed to variable valve spool contained within a fuel block for regulating fuel flow returns to the fuel cell through a 1 lb check valve; and the regulated and adjusted fuel is then returned to the fuel tank; and wherein the variable valve spool contained within a fuel block for regulating fuel flow is further comprised of:

a first fuel block body side is comprised of shaft hole with a lip seal and machined o-ringed grove on the interior surface for retaining an O-ring to seal the two body sections/sides and when bolted together; and a second fuel block body side is comprised of and interior surface comprising an inlet fuel port and outlet fuel port, connected by a cylindrical opening where a cylindrical shaped variable valve spool is retained that allows for the regulation of a fuel flow.

2. The device of claim 1, wherein the main jet return line contains a 1 lb. check valve is provided for idle purposes to ensure the engine will run and idle during under partial throttle conditions; and at idle, the barrel valve sends fuel to the engine and through a secondary bypass valve containing a 15 lb. check valve to return unused fuel to the tank.

3. The device of claim 1, wherein the variable valve spool is controlled by a stepper motor and printed circuit board (PCB) as directed by signals from a wideband O2 sensor located in the exhaust; and the variable valve spool contained within a fuel block for regulating fuel flow limits the amount of fuel returned to the tank before the barrel valve to keep the engine running at a desired AFR.

4. The device of claim 2, further comprising a main jet located between the variable valve spool contained within a fuel block for regulating fuel flow and the injector is used for coarse tuning.

5. The device of claim 1, wherein the interior surface of the second body side is comprised of inlet fuel port and outlet fuel port which passes fuel through the cylindrical opening where the cylindrical shaped variable valve spool is retained;

the fuel flows from the inlet port fuel intersection through the cylindrical opening and through a valley or "v" channel in the variable valve spool and into the outlet port; and a dead area is provided to shut fuel off in the event of a lean condition.

6. The device of claim 1, further comprising a cylindrical protrusion limits the travel of the cylindrical shaped variable valve spool when retained inside the orifice; and the protrusion matches and corresponds to a half-moon shape in the bottom of the spool where the protrusion allows the variable valve spool to rotated around the shaft axis from end to end of the machined half-moon shape and stops the spool's motion when the protrusion and end point of the machined half-moon shape and protrusion make contact.

7. The device of claim 1, further comprising a flat circular low friction area is provided to reduce friction only;

the center of the bottom of the spool rides along and against the low friction area to provide smooth movement of the spool.

8. The device of claim 7, wherein the low friction area is further comprised of a set screw with a coated, low friction end surface and a lock nut;

the set screw is screwed into the second body side and the pressure exerted on the spool bottom is adjustable; and when the desired pressure is set to retain the spool in its location, the lock nut is tighten to retain the set screw and coated low friction end surface securely in place at the desired setting.

9. The device of claim 8, wherein the variable valve spool is comprised of a seal surface area;

two friction reduction grooves 134 and 135;

a fuel channel;

when the variable valve spool is placed within the body, the lip seal provides a leak free, low friction connection between the stepper motor shaft and the variable valve spool;

the opposing end of the variable valve spool from the shaft rides against the coated low friction end surface of the interior of the second body side for further friction reduction;

the valley or "v" shaped fuel channel is aligned with the fuel channel of the inlet port 102 and outlet port 104 area of the interior of the second body side;

fuel flows through this area only;

the flow is variable due to the changing depth of the valley or "v" groove; and as the spool is rotated, an increase or decrease in fuel occurs as more or less of the valley or "v" grove is used to channel fuel from port the inlet port to the outlet port, resulting in a change in fuel delivery to the engine and an adjustment of the air fuel ratio.

10. The device of claim 7, further comprising two additionally machined channels adjacent to the valley or "v" shaped fuel channel.

* * * * *